US010854187B2

(12) United States Patent
Tachi et al.

(10) Patent No.: US 10,854,187 B2
(45) Date of Patent: Dec. 1, 2020

(54) ACTIVE NOISE CONTROL SYSTEM AND ON-VEHICLE AUDIO SYSTEM

(71) Applicants: ALPINE ELECTRONICS, INC., Tokyo (JP); A School Corporation Kansai University, Suita (JP)

(72) Inventors: Ryosuke Tachi, Fukushima (JP); Yoshinobu Kajikawa, Suita (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 16/508,624

(22) Filed: Jul. 11, 2019

(65) Prior Publication Data

US 2020/0020315 A1 Jan. 16, 2020

(30) Foreign Application Priority Data

Jul. 13, 2018 (JP) ..... 2018-133739

(51) Int. Cl.
*G10K 11/00* (2006.01)
*G10K 11/178* (2006.01)

(52) U.S. Cl.
CPC .. *G10K 11/17854* (2018.01); *G10K 11/17823* (2018.01); *G10K 2210/1282* (2013.01); *G10K 2210/3028* (2013.01)

(58) Field of Classification Search
CPC ..... G10K 11/17854; G10K 11/17828; G10K 2210/1282; G10K 2210/3028; G10K 11/17823; G10K 2210/128; G10K 2210/1281; G10K 2210/12821; G10K 2210/1283; G10K 2210/12822
(Continued)

(56) References Cited

U.S. PATENT DOCUMENTS 5,917,919 A * 6/1999 Rosenthal ..... G10K 11/178 381/71.11
2010/0177905 A1 7/2010 Shridhar et al.
(Continued)

FOREIGN PATENT DOCUMENTS

JP 6-195089 7/1994

OTHER PUBLICATIONS

Extended European Search Report dated Jan. 2, 2020 in corresponding European Application No. 19186066.7.
(Continued)

*Primary Examiner* — Disler Paul
(74) *Attorney, Agent, or Firm* — Brinks Gilson & Lione

(57) ABSTRACT

Audio (noise source) is output as a cancellation sound through a variable filter and a first filter, and transmitted to the second filter. A subtractor subtracts an output of a second filter from an output of a microphone, and an adaptive algorithm execution unit updates a transfer function of the variable filter so that the subtracted result becomes zero (0). A transfer function A for the first filter is a transfer function which can cancel noise at a position of a user's ear by setting, as the cancellation sound, a sound obtained by applying the transfer function A to audio at the time of learning, and a transfer function B for the second filter is a transfer function which can eliminate, for the cancellation sound, a difference between a sound obtained by applying the transfer function B to audio and the output of the microphone.

7 Claims, 8 Drawing Sheets

(58) Field of Classification Search
USPC ..... 381/71.1, 71.7, 71.4, 71.6, 71.11
See application file for complete search history.

(56) References Cited

U.S. PATENT DOCUMENTS

| | | | | |
|---|---|---|---|---|
| 2011/0305347 | A1* | 12/2011 | Wurm ..... | G10K 11/17854 381/71.1 |
| 2012/0170764 | A1 | 7/2012 | Shridhar et al. | |
| 2017/0287462 | A1* | 10/2017 | Christoph ..... | H04R 5/023 |

OTHER PUBLICATIONS

Kuo et al., "Active Noise Control: A Tutorial Review", Proceedings of the IEEE, vol. 87, No. 6, Jun. 1999, pp. 943-973.

* cited by examiner

ACTIVE NOISE CONTROL SYSTEM AND ON-VEHICLE AUDIO SYSTEM

RELATED APPLICATIONS

The present application claims priority to Japanese Patent Appln. No. 2018-133739, filed Jul. 13, 2018, the entire disclosure of which is hereby incorporated by reference.

BACKGROUND

Field of the Disclosure

The present disclosure relates to a technology of active noise control (ANC) that is capable of reducing noise by emitting a cancellation sound which cancels noise.

Description of the Related Art

As with a technology of active noise control which reduces noise by emitting a cancellation noise that cancels noise, there is also a technology in which a speaker emits cancellation noise, a microphone is disposed near a position of an ear of a user, and an adaptive filter applies a set transfer function to a signal simulating noise generated by a noise source to generate a cancellation sound are provided. By setting a transfer function of an output of a microphone as an error signal, the transfer function is adaptively set in the adaptive filter to generate the cancellation noise which cancels noise at the position of the microphone near the position of the ear of the user (see, for example, JP 6-195089 A).

In addition, there is a known technology (JP 6-195089 A) of obtaining a difference between the transfer function from the noise source to the position of the ear of the user and the transfer function from the noise source to the microphone; obtaining a difference between the transfer function from the speaker to the position of the ear of the user and the transfer function from the speaker to the microphone; and correcting the error signal using the obtained differences between each of the transfer functions so that the transfer function generating the cancellation sound cancels the noise at the position of the ear of the user.

SUMMARY

According to the technology of correcting the error signal so that the transfer function set to cancel the noise at the position of the ear of the user described above is set in the adaptive filter, the error signal is corrected using the previously obtained difference between the transfer function from the noise source to the position of the ear of the user and the transfer function from the noise source to the microphone, such that if the transfer function from the noise source to the ear of the user or the transfer function from the noise source to the microphone is changed, the transfer function cannot be appropriately set in the adaptive filter and the cancellation sound which cancels the noise at the position of the ear of the user cannot be generated.

Therefore, an objective of the present disclosure is to provide an active noise control system that generates a cancellation sound which cancels noise at a position of an ear of a user using a microphone disposed at a position near the position of the ear of the user and outputs the generated cancellation sound from a speaker. The generated cancellation sound is adapted to a change in a transfer function from a noise source to the position of the ear of the user or is adapted to change in a transfer function from the noise source to the microphone.

Another objective of the present disclosure is to provide an on-vehicle audio system to which such an active noise control system is applied.

To achieve the above objectives, the present disclosure provides an active noise control device reducing noise, including: a speaker configured to output a cancellation sound which cancels noise at a predetermined noise cancel position; a microphone configured to pick-up a synthetic sound of the noise with the cancellation sound and to output the picked up synthetic sound as an error signal; and a cancellation sound generation unit configured to generate the cancellation sound output from the speaker.

The cancellation sound generation unit includes an adaptive filter configured to use, as an input, a noise signal which is a signal indicating noise generated from a noise source of the noise, a first filter configured to set an output of the adaptive filter as an input and output the cancellation sound, and a second filter configured to set the output of the adaptive filter as the input. In addition, by setting a difference between an output of the microphone and an output of the second filter as an error, the adaptive filter updates a transfer function for the adaptive filter by a predetermined adaptive algorithm. A transfer function for the first filter is set in the first filter, and the transfer function for the first filter is set so that the noise at the noise cancellation position is canceled when the cancellation sound generation unit generates, as the noise cancellation sound, a sound which is obtained by applying the transfer function for the first filter to the noise signal in a predetermined standard state. In addition, a transfer function for the second filter is set in the second filter, and the transfer function for the second filter is set so that the error is an output of a virtual microphone disposed at the noise cancellation position when the transfer function for the adaptive filter is a transfer function which sets, as an output, an input as it is in the predetermined standard state.

The present disclosure further provides an active noise control device for reducing noise, including: a speaker configured to output a cancellation sound which cancels noise at a predetermined noise cancel position; a microphone configured to pick-up a synthetic sound of the noise with the cancellation sound and output the picked up synthetic sound as an error signal; and a cancellation sound generation unit configured to generate the cancellation sound output from the speaker. Here, the cancellation sound generation unit includes an adaptive filter configured to use, as an input, a noise signal which is a signal indicating noise generated from a noise source of the noise, a first filter configured to set an output of the adaptive filter as an input and output the cancellation sound, and a second filter configured to set the output of the adaptive filter as the input. In addition, by setting a difference between an output of the microphone and an output of the second filter as an error, the adaptive filter updates a transfer function for the adaptive filter by a predetermined adaptive algorithm. Here, a transfer function for the first filter learned by a predetermined learning processing is set in the first filter and a transfer function for the second filter learned by the learning processing is set in the second filter. Here, the transfer function for the first filter is "$-V(z)/Sv(z)$", where $V(z)$ is set as a transfer function from the noise source to the noise cancellation position and $Sv(z)$ is set as a transfer function from the cancellation sound generation unit to the noise cancellation position at a time when the learning processing is executed.

The transfer function for the second filter is "P(z){V(z)/Sv(z)}S(z)", where P(z) is set as a transfer function from the noise source to the microphone and S(z) is set as a transfer function from the cancellation sound generation unit to the microphone at a time when the learning processing is executed.

The present disclosure further provides an active noise control device reducing noise, including: a speaker configured to output a cancellation sound which cancels noise at a predetermined noise cancel position; a microphone configured to pick-up a synthetic sound of the noise with the cancellation sound and output the picked up synthetic sound as an error signal; and a cancellation sound generation unit configured to generate the cancellation sound output from the speaker. Here, the cancellation sound generation unit includes an adaptive filter configured to use, as an input, a noise signal which is a signal indicating noise generated from a noise source of the noise; a first filter configured to set an output of the adaptive filter as an input and output the cancellation sound; and a second filter configured to set the output of the adaptive filter as the input.

By setting a difference between an output of the microphone and an output of the second filter as an error, the adaptive filter updates a transfer function for the adaptive filter by a predetermined adaptive algorithm. Here, a transfer function for the first filter learned by a predetermined learning processing is set in the first filter and a transfer function for the second filter learned by the learning processing is set in the second filter.

The learning processing includes learning, as the transfer function for the first filter, the first transfer function of which the noise at the noise cancellation position is canceled in the configuration in which the cancellation sound generation unit is replaced with a first learning unit which generates, as the cancellation sound, a sound obtained by applying a first transfer function to the noise signal. The learning processing further includes learning the second transfer function as the transfer function for the second filter without the difference between the output of the microphone and a sound obtained by applying the second transfer function to the noise signal in the configuration in which the cancellation sound generation unit is replaced with the second learning unit which generates, as the cancellation sound, the sound obtained by applying the transfer function for the first filter to the noise signal.

The active noise control device in which the transfer function for the first filter learned by the learning processing is set in the first filter and the transfer function for the second filter learned by the learning processing is set in the second filter, as described above, may include a learning processing execution unit which executes the learning processing to set the transfer function for the first filter in the first filter and set the transfer function for the second filter in the second filter.

The present disclosure also provides an on-vehicle audio system mounted in the vehicle, which includes the above-described active noise control device. Here, the on-vehicle audio system includes an audio device for a user who sits in a first seat of a vehicle, which emits audio into the vehicle. The noise is the audio emitted from the audio device, the noise signal is an audio signal output from the sound source of the audio device, the noise cancellation position is a position of an ear of a user who sits in a second seat of the vehicle, and the microphone is disposed at a position near the position of the ear of the user who sits in the second seat.

According to forms of the above-described active noise control device or the on-vehicle audio system, as will be described in detail, even if the transfer function from the noise source to the noise cancellation position and the transfer function from the noise source to the microphone are change similarly, it is possible to cancel the noise at the noise cancellation position with the cancellation sound according to the adaptation to the change.

As described above, according to forms of the present disclosure, in the active noise control system which generates the cancellation sound which cancels the noise at the position of the ear of the user using the microphone disposed at the position near the position of the ear of the user and outputs the generated cancellation sound from the speaker, the generated cancellation sound can be adapted to the change in the transfer function from a noise source to the position of the ear of the user or the transfer function from the noise source to the microphone.

In addition, according to forms of the present disclosure, it is possible to provide the on-vehicle audio system to which such an active noise control system is applied.

DESCRIPTION OF THE DRAWINGS

Hereinafter, examples in which embodiments and implementations of the present disclosure will be applied to an audio system mounted in a vehicle will be described.

Figure 1:
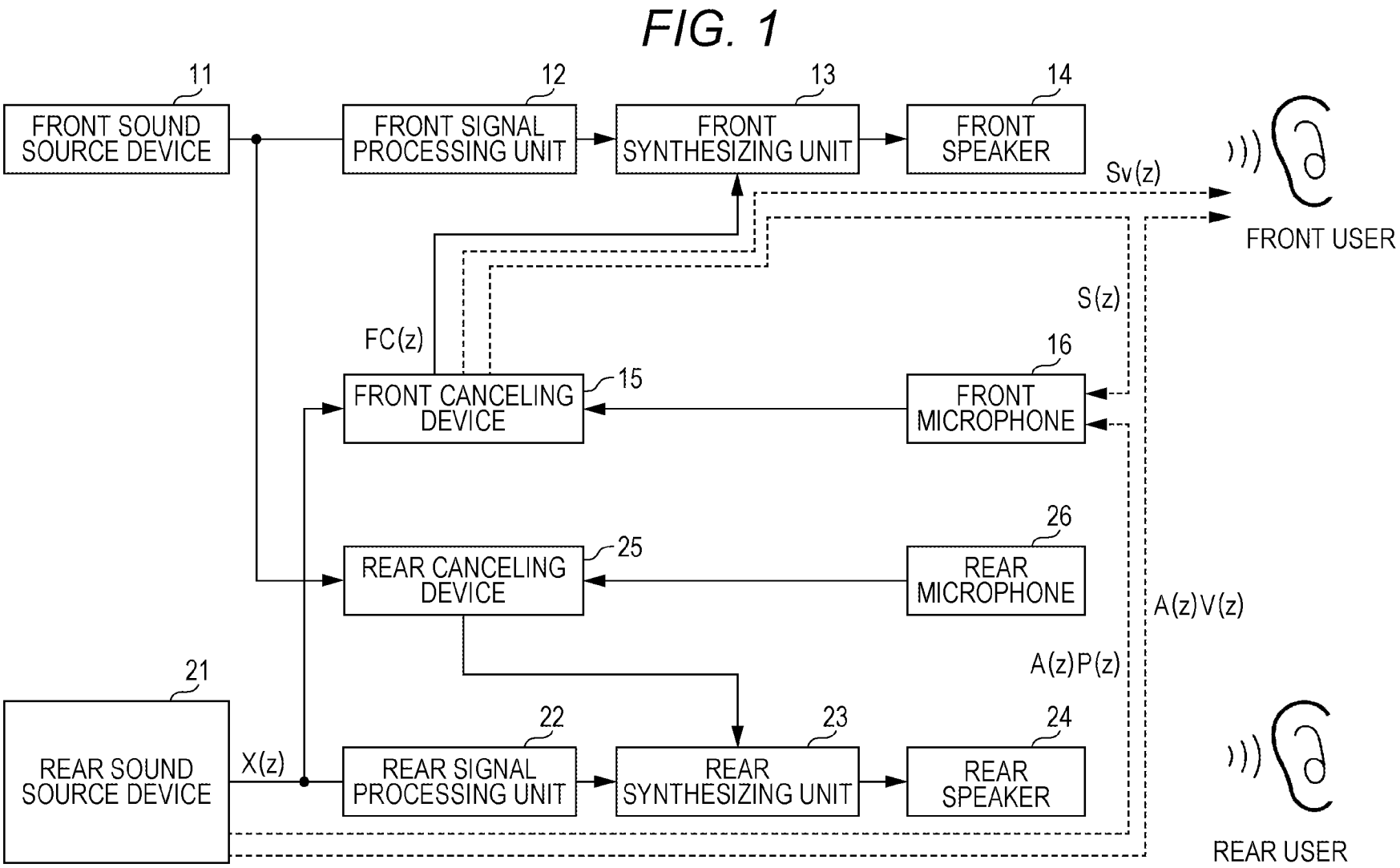
FIG. 1 is a block diagram illustrating a configuration of one form of an audio system.

FIG. 1 illustrates a configuration of one form an audio system.

As illustrated in FIG. 1, the audio system includes a front sound source device 11, a front signal processing unit 12, a front synthesizing unit 13, a front speaker 14, a front canceling device 15, and a front microphone 16.

In addition, the audio system includes a rear sound source device 21, a rear signal processing unit 22, a rear synthesizing unit 23, a rear speaker 24, a rear canceling device 25, and a rear microphone 26.

Figure 2A:
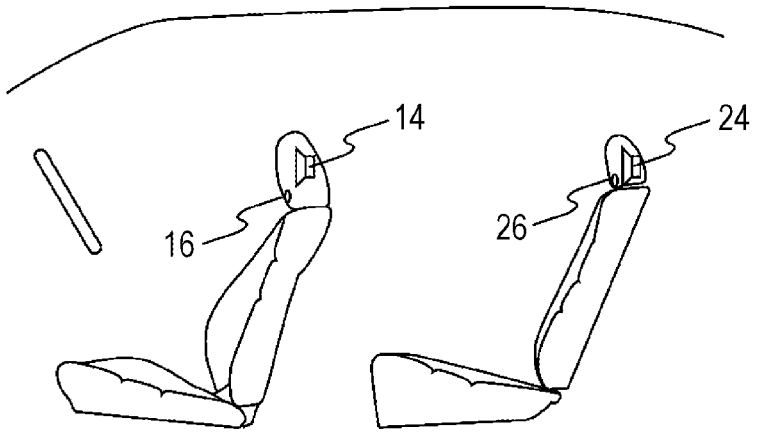
FIGS. 2A, 2B are views illustrating one form an arrangement of a speaker and a microphone.

The front speaker 14 is a speaker for a front user who is a user sitting in a front seat of a vehicle, and is disposed, for example, at a position next to a headrest of the front seat as illustrated in FIG. 2A. In addition, as illustrated in FIG. 2A, the front microphone 16 is disposed at a position near a position of an ear of the user sitting in the front seat, such as the headrest of the front seat.

The rear speaker 24 is a speaker for a rear user who is a user boarding a rear seat of the vehicle, and is disposed, for example, at a position next to a headrest of the rear seat as illustrated in FIG. 2A. As illustrated in FIG. 2A, the rear microphone 26 is disposed at a position near a position of an ear of the user sitting in the rear seat, such as the headrest of the rear seat.

Returning to FIG. 1, the front sound source device 11 is a device serving as a sound source of audio that the front user listens to, such as a music player or a radio, and the front signal processing unit 12 is a device which performs predetermined signal processing on audio output from the front sound source device 11 such as an equalizer and outputs the audio.

The rear sound source device 21 is a device serving as a sound source of audio that the rear user listens to, such as the music player or the radio, and the rear signal processing unit 22 is a device which performs predetermined signal processing on audio output from the rear sound source device 21 such as the equalizer.

The front canceling device 15 generates and outputs a front cancellation sound from a voice picked up by the front microphone 16 and the audio output from the rear sound source device 21, and the front synthesizing unit 13 synthesizes the audio output from the front signal processing unit 12 with the front cancellation sound output from the front canceling device 15 and outputs the synthesized signal from the front speaker 14.

The rear canceling device 25 generates and outputs a rear cancellation sound from a voice picked up by the rear microphone 26 and the audio output from the front sound source device 11, and the rear synthesizing unit 23 synthesizes the audio output from the rear signal processing unit 22 with the rear cancellation sound output from the rear canceling device 25 and outputs the synthesized signal from the rear speaker 24.

Here, the audio of the sound source for the rear sound source device 21, which is transmitted from the rear speaker 24, is noise for the front user, and the sound of the sound source for the front sound source device 11, which is transmitted from the front speaker 14, is noise for the rear user.

The position of the ear of the front user is a noise cancellation position where the noise for the front user is to be canceled, and the position of the ear of the rear user is a noise cancellation position where the noise for the rear user is to be canceled.

The front cancellation sound generated and output from the front canceling device 15 is a sound for canceling the audio (noise) transmitted from the rear speaker 24 at the position of the ear of the front user, and the rear cancellation sound generated and output from the rear canceling device 25 is a sound for canceling the audio (noise) transmitted from the front speaker 14 at the position of the ear of the rear user.

Figure 3:
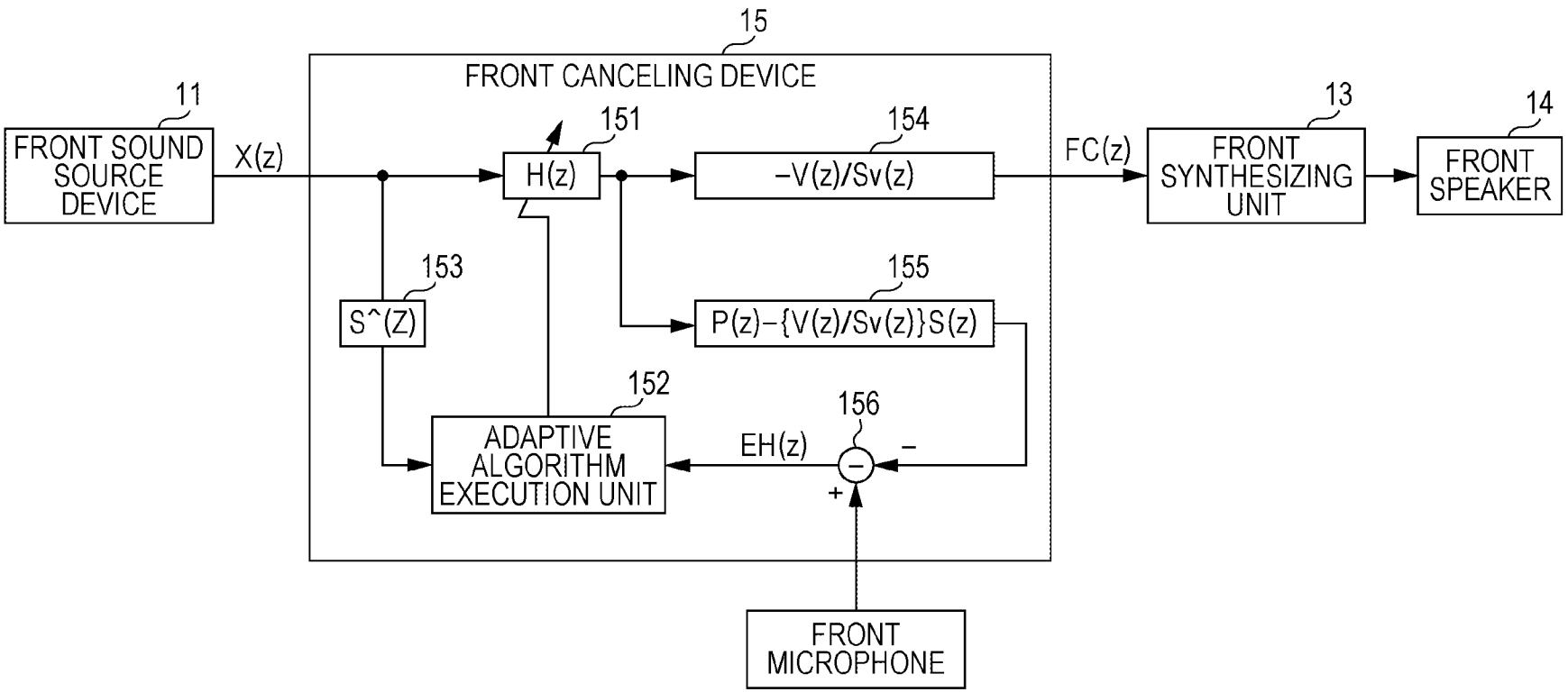
FIG. 3 is a block diagram illustrating a configuration of one form of a front canceling device.

Next, the configuration of one form of the front canceling device 15 is illustrated in FIG. 3.

As illustrated in FIG. 3, the front canceling device 15 includes a variable filter 151, an adaptive algorithm execution unit 152, a transfer model 153, a first filter 154, a second filter 155, and a subtractor 156.

A transfer function "$-V(z)/Sv(z)$" is set in the first filter 154 by learning processing performed in advance, and a transfer function "$P(z)\{V(z)/Sv(z)\}S(z)$" is set in the second filter 155 by the learning processing.

The learning processing will be described in detail later.

As illustrated in FIG. 1, $A(z)V(z)$ is the transfer function from the current rear sound source device 21 to the ear of the front user; $A(z)P(z)$ is the transfer function from the current rear sound source device 21 to the front microphone 16; $Sv(z)$ is the transfer function from the front canceling device 15 to the ear of the front user; and $S(z)$ is the transfer function from the front canceling device 15 to the front microphone 16.

Further, $V(z)$ is the transfer function from the rear sound source device 21 to the ear of the front user at the time of executing the learning processing described above, and $P(z)$ is the transfer function from the rear sound source device 21 to the front microphone 16 at the time of executing the learning processing described above.

The transfer function $V(z)$ from the rear sound source device 21 to the ear of the front user or the transfer function $P(z)$ from the rear sound source device 21 to the front microphone 16 is changed in the same manner as the movement of the front sheet or the rear sheet or the change (change in setting of the equalizer, change in a delayed time or the like) in the content of the signal processing performed by the front signal processing unit 12. $A(z)$ represents the change in the transfer function.

On the other hand, the transfer function $Sv(z)$ from the front canceling device 15 to the ear of the front user and the transfer function $S(z)$ from the front canceling device 15 to the front microphone 16 can be considered not to be changed because the positional relationship between the front speaker 14 and the ear of the front user or the front microphone 16 is appropriately constant.

By setting $X(z)$ as the audio output from the rear sound source device 21, $FC(z)$ as the front cancellation sound generated and output from the front canceling device 15, and $H(z)$ as the transfer function for the variable filter 151, the audio $X(z)$ input from the rear sound source device 21 to the front canceling device 15 passes through the variable filter 151 and the first filter 154 and is output to the front speaker 14 via the front synthesizing unit 13 as the front cancellation sound $FC(z)$.

Also, the audio $X(z)$ input from the rear sound source device 21 to the front canceling device 15 is transmitted to the subtractor 156 through the variable filter 151 and the second filter 155, and the subtractor 156 subtracts the output of the second filter 155 from the sound picked up by the front microphone 16 and outputs the subtracted result to the adaptive algorithm execution unit 152 as an error $EH(z)$.

Next, the variable filter 151, the adaptive algorithm execution unit 152, and the transfer model 153 configures a (Filtered-X) adaptive filter, and the transfer model 153 inputs a preset propagation characteristic $\hat{S}A(z)$ such as a phase delay from the front canceling device 15 to the front microphone 16 to the adaptive algorithm execution unit 152 by convoluting the propagation characteristic $\hat{S}A(z)$ with the audio $X(z)$ input from the rear sound source device 21 to the front canceling device 15.

Then, the adaptive algorithm execution unit 152 executes an adaptive algorithm such as NLMS or LMS using, as an input, the audio $X(z)$ with which the propagation characteristic $\hat{S}A(z)$ is convoluted by the transfer model 153 and the error $EH(z)$, and sets the transfer function $H(z)$ for the variable filter 151 so that the error $EH(z)$ becomes 0.

Here, since the sound picked up by the front microphone 16 is $\{A(z)P(z)\}X(z)-\{H(z)V(z)S(z)/Sv(z)\}X(z)$, which is obtained by adding the front cancellation sound transmitted to the position of the front microphone 16 to the audio of the sound source of the rear sound source device 21 transmitted to the position of the front microphone 16, $EH(z)=\{A(z)P(z)-H(z)V(z)S(z)/Sv(z)\}X(z)-<<H(z)[P(z)-\{V(z)/Sv(z)\}S(z)]>>X(z)$ is satisfied, and the adaptive algorithm setting the transfer function $H(z)$ for the variable filter 151 so that $EH(z)$ is minimum is executed and thus the transfer function for the variable filter 151 is set to $H(z)=A(z)$.

A difference $Ev(z)$ between the audio of the sound source of the rear sound source device 21 and the front cancellation sound at the position of the ear of the front user is an addition of the audio of the sound source of the rear sound source device 21 transmitted to the position of the ear of the front user to the front cancellation sound transmitted to the position of the ear of the front user.

Since $Ev(z)=\{A(z)V(z)\}X(z)-\{H(z)V(z)Sv(z)/Sv(z)\}X(z)$, when $H(z)=A(z)$, $Ev(z)=0$.

Therefore, the front canceling device 15 can cancel the audio of the sound source of the rear sound source device 21 with the front cancellation sound, at the position of the ear of the front user.

Further, when the transfer function from the rear sound source device 21 to the ear of the front user changes from $V(z)$ to $A(z)V(z)$ at the time of the execution of the learning processing and the transfer function from the rear sound source device 21 to the front microphone 16 changes from $P(z)$ to $A(z)P(z)$ at the time of the execution of the learning processing, that is, the transfer function from the rear sound source device 21 to the ear of the front user and the transfer function from the rear sound source device 21 to the front microphone 16 change similarly, the front canceling device 15 can cancel the audio of the sound source of the rear sound source device 21 with the front cancel sound according to the adaptation to the change, at the position of the ear of the front user.

Next, the above-described learning processing to be performed in advance will be described.

The learning processing is performed by setting the positions of the front and rear seats or the content of the signal processing performed by the rear signal processing unit 22 to be the predetermined standard state.

The learning processing includes learning processing of a first stage of setting the transfer function in the first filter 154 and learning processing of a second stage of setting the transfer function in the second filter 155.

Figure 2B:
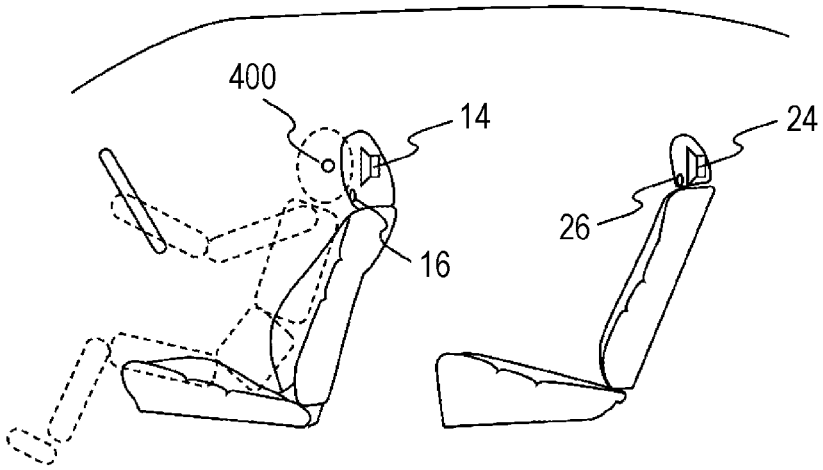
Figure 4:
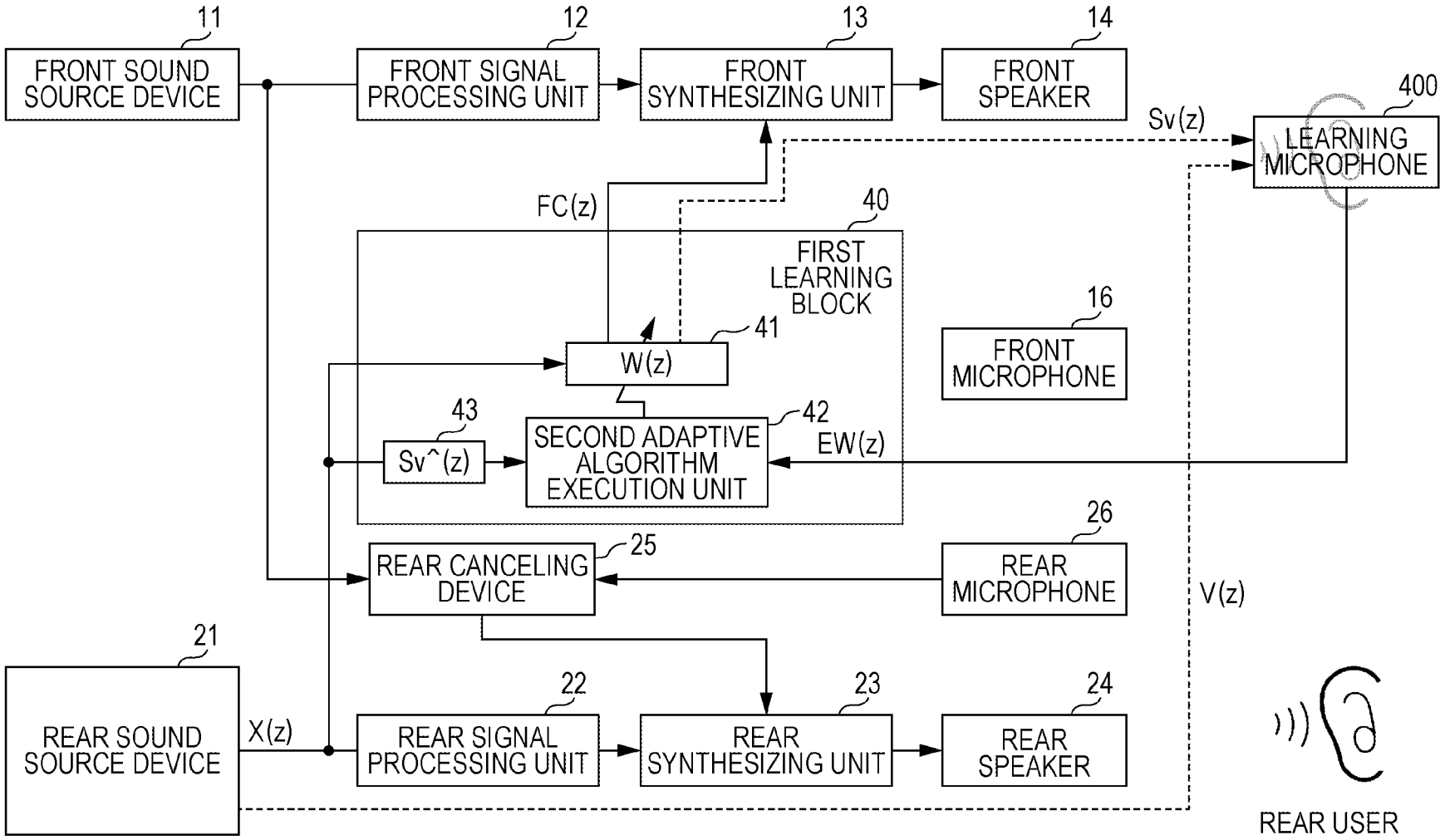
FIG. 4 is a diagram illustrating a first stage of learning.

As illustrated in FIG. 4, the learning processing of the first stage is performed in a configuration in which the front canceling device 15 of the audio system of FIG. 1 is replaced with a first learning block 40. In addition, as illustrated in FIG. 2B, the learning processing of the first stage is performed using a learning microphone 400 which is disposed at the position which is normally the ear of the front user. Here, the disposition of the learning microphone 400 at the position which is normally the ear of the front user is realized, for example, by disposing the learning microphone 400 at a position of an ear of a dummy doll on the front seat.

The first learning block 40 includes a second variable filter 41, a second adaptive algorithm execution unit 42, and a second transfer model 43, and the second variable filter 41, the second adaptive algorithm execution unit 42, and the second transfer model 43 constitutes a (Filtered-X) adaptive filter.

By setting $W(z)$ as the transfer function for the second variable filter 41, the audio $X(z)$ input from the rear sound source device 21 to the first learning block 40 passes through the second variable filter 41 and is output to the front speaker 14 via the front synthesizing unit 13 as the front cancellation sound $FC(z)$.

The second transfer model 43 inputs the preset propagation characteristic $Sv\hat{}A(z)$ such as the phase delay from the front canceling device 15 to the learning microphone 400 to the second adaptive algorithm execution unit 42 by convoluting the propagation characteristic $Sv\hat{}A(z)$ with the audio $X(z)$ input from the rear sound source device 21 to the front canceling device 15.

Further, the second adaptive algorithm execution unit 42 executes the adaptive algorithm such as NLMS or LMS by setting the sound picked up by the learning microphone 400 as an error $EW(z)$ and setting, as an input, the audio $X(z)$ in which the propagation characteristic $Sv\hat{}A(z)$ is convoluted by the second transfer model 43 and the error $EW(z)$, and sets the transfer function $W(z)$ of the second variable filter 41 so that the error $EW(z)$ becomes minimum.

Since the error $EW(z)$ picked up by the learning microphone 400 disposed at the position of the ear of the front user is $EW(z)=\{V(z)\}X(z)+\{W(z)Sv(z)\}X(z)$ obtained by adding the front cancellation sound transmitted to the position of the ear of the front user to the audio of the sound source of the rear sound source device 21 transmitted to the position of the ear of the front user, the transfer function $W(z)$ for the second variable filter 41 is set to be $W(z)=-V(z)/Sv(z)$ by executing the adaptive algorithm which sets the transfer function $W(z)$ for the second variable filter 41 so that $EW(z)$ becomes 0.

The transfer function $W(z)=-V(z)/Sv(z)$ for the first variable filter thus obtained is a function of generating the front cancellation sound, normally at the position of the ear of the front user.

When the transfer function $W(z)$ for the second variable filter 41 has converged, the learning processing of the first stage is terminated, and the learning processing of the second stage is performed using "$-V(z)/Sv(z)$" obtained as the transfer function $W(z)$ for the second variable filter 41 in the learning processing of the first stage.

Figure 5:
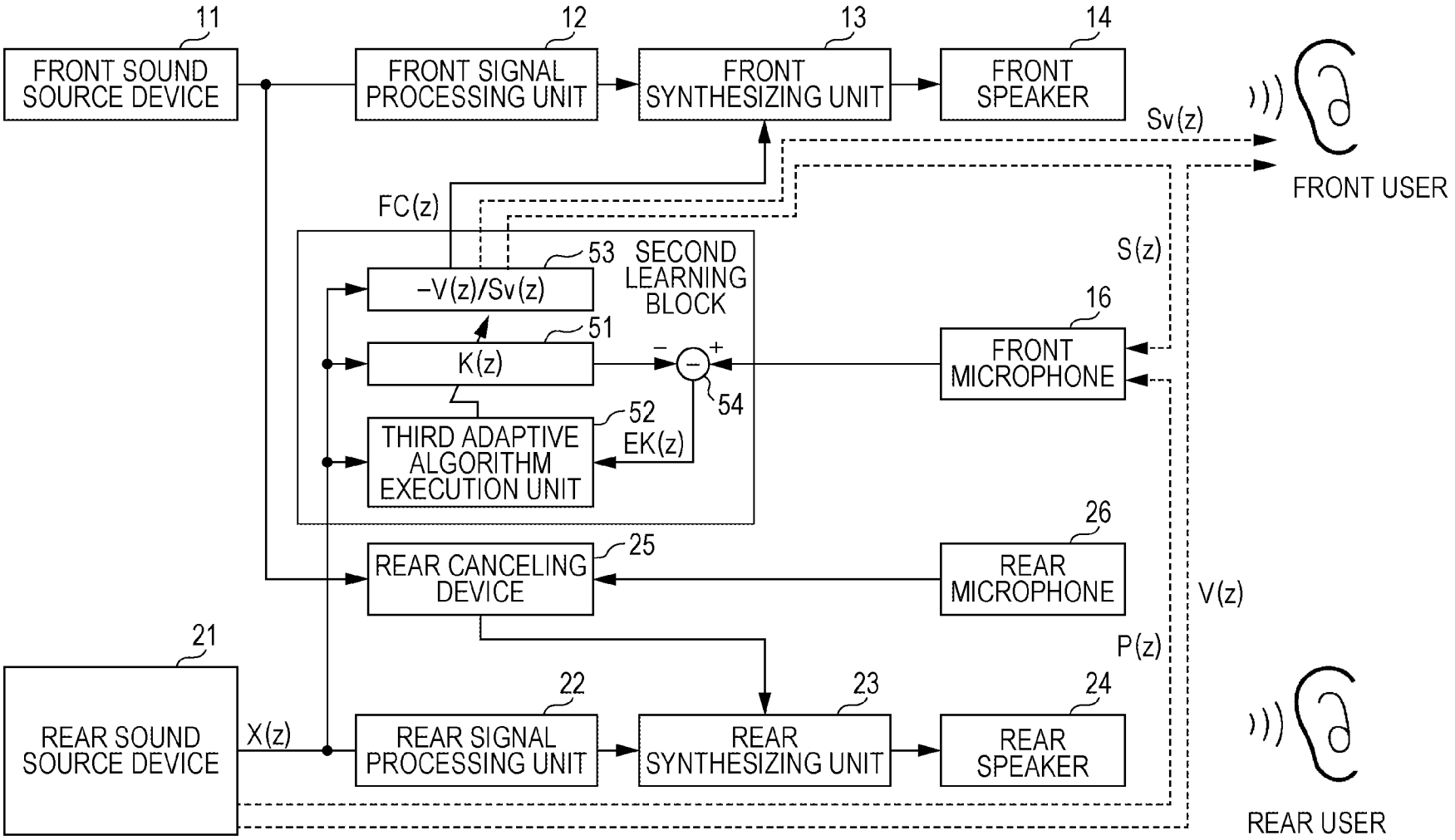
FIG. 5 is a diagram illustrating a second stage of learning.

As illustrated in FIG. 5, the learning processing of the second stage is performed in a configuration in which the front canceling device 15 of the audio system of FIG. 1 is replaced with a second learning block 50.

The second learning block 50 includes a third variable filter 51, a third adaptive algorithm execution unit 52, a learning filter 53, and a second subtractor 54.

Here, the third variable filter 51 and the third adaptive algorithm execution unit 52 constitute an adaptive filter.

In addition, "$-V(z)/Sv(z)$" obtained as the transfer function $W(z)$ for the second variable filter 41 in the learning processing of the first stage is set as the transfer function in the learning filter 53.

By setting $K(z)$ as the transfer function for the third variable filter 51, the audio $X(z)$ input from the rear sound source device 21 to the second learning block 50 passes through the learning filter 53 and is output to the front speaker 14 via the front synthesizing unit 13 as the front cancellation sound $FC(z)$.

Further, the audio $X(z)$ is transmitted to the second subtractor 54 through the third variable filter 51, and the second subtractor 54 subtracts the output of the third variable filter 51 from the sound picked up by the front microphone 16, and outputs the subtracted result as an error $EK(z)$ to the third adaptive algorithm execution unit 52.

The third adaptive algorithm execution unit 52 executes the adaptive algorithm such as the NLMS or the LMS and sets the transfer function $K(z)$ for the third variable filter 51 from the errors $EK(z)$ and audio $X(z)$ so that the error $EK(z)$ becomes 0.

Here, since the sound picked up by the front microphone 16 is $\{P(z)\}X(z)-[\{V(z)/Sv(z)\}S(z)]X(z)$ obtained by adding the front cancellation sound transmitted to the position of the front microphone 16 to the audio of the sound source of the rear sound source device 21 transmitted to the position of the front microphone 16, the error $EK(z)=\{P(z)\}X(z)-[\{V(z)/Sv(z)\}S(z)]X(z)-\{K(z)\}X(z)$ is satisfied, and the adaptive algorithm setting the transfer function $K(z)$ for the third variable filter 51 so that $EK(z)$ becomes 0 is executed, such that the transfer function $K(z)$ for the third variable filter 51 is set to $K(z)=P(z)-\{V(z)/Sv(z)\}S(z)$.

Next, if the transfer function K(z) for the third variable filter 51 is converged, the learning processing of the second stage is terminated.

The transfer function K(z)=P(z){V(z)/Sv(z)}S(z) for the second variable filter 41 thus obtained corrects the output of the front microphone 16 with the output of the virtual microphone disposed at the position of the ear of the front user by subtracting the output of the second variable filter 41 from the output of the front microphone 16.

Then, the learning processing is terminated by setting "−V(z)/Sv(z)" obtained as the transfer function W(z) for the second variable filter 41 in the learning processing of the first stage in the first filter 154 of the front canceling device 15 and setting "P(z){V(z)/Sv(z)}S(z)" obtained as the transfer function K(z) for the third variable filter 51 in the learning processing of the second stage in the second filter 155 of the front canceling device 15.

The learning processing has been described above.

However, the front canceling device 15 may be configured to include the function of performing the learning processing described above.

Figure 6:
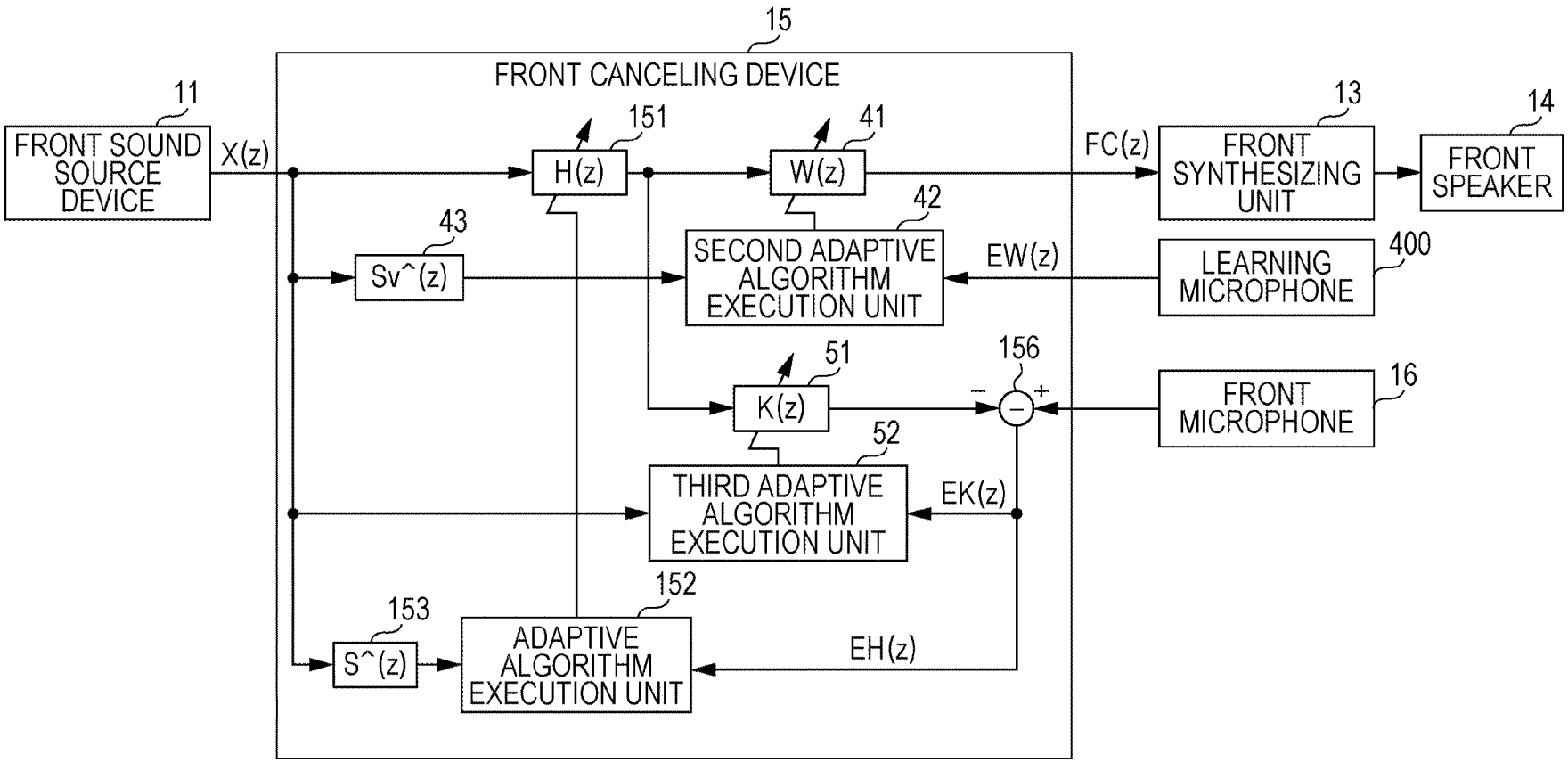
FIG. 6 is a block diagram illustrating another form of a configuration of a front canceling device.

That is, in this case, as illustrated in FIG. 6, the front canceling device 15 is configured to include the variable filter 151, the adaptive algorithm execution unit 152, the transfer model 153, the subtractor 156, the second variable filter 41, the second adaptive algorithm execution unit 42, the second transfer model 43, the third variable filter 51, and the third adaptive algorithm execution unit 52.

In this case, the propagation characteristic S^A(z) from the front canceling device 15 to the front microphone 16 is preset in the transfer model 153, and the propagation characteristic Sv^A(z) from the front canceling device 15 to the learning microphone 400 is preset in the second transfer model 43.

The audio X(z) input from the rear sound source device 21 to the front canceling device 15 is input to the variable filter 151, the transfer model 153, the second transfer model 43, and the third adaptive algorithm execution unit 52.

The output of the transfer model 153 is input to the adaptive algorithm execution unit 152, and the output of the second transfer model 43 is input to the second adaptive algorithm execution unit 42.

The output of the variable filter 151 is input to the second variable filter 41, and the output of the second variable filter 41 is output to the front speaker 14 via the front synthesizing unit 13 as the front cancellation sound.

In addition, the output of the variable filter 151 is input to the third variable filter 51, and the output of the third variable filter 51 is input to the subtractor 156. The subtractor 156 outputs the difference between the output of the front microphone 16 and the output of the third variable filter 51 to the third adaptive algorithm execution unit 52 and the adaptive algorithm execution unit 152.

In addition, the second adaptive algorithm execution unit 42 can selectively connect the output of the learning microphone 400.

Here, in such a front canceling device 15, the learning processing is as follows.

That is, first, in the learning processing of the first stage, the transfer function H(z) for the variable filter 151 is set to the transfer function which passes through the signal as it is, in the state in which the operation of the adaptive algorithm execution unit 152 is stopped, the learning microphone 400 disposed at the position of the ear of the user of the front sheet is connected to the second adaptive algorithm execution unit 42, and the first adaptive algorithm execution unit executes the adaptive algorithm from the audio X(z) with which the propagation characteristic Sv^A(z) is convoluted by the second transfer model 43 and the error EW(z) by setting the output of the learning microphone 400 as the error EW(z) in order to set the transfer function W(z) of which the error EW(z) becomes 0 in the second variable filter 41.

If the transfer function W(z) for the second variable filter 41 is converged, the operation of the second adaptive algorithm execution unit 42 is stopped and the transfer function W(z) for the second variable filter 41 is fixed.

Next, in the learning processing of the second stage, the transfer function H(z) for the variable filter 151 is set to the transfer function which passes through the signal as it is, and in the state where the operation of the adaptive algorithm execution unit 152 and the operation of the second adaptive algorithm execution unit 42 are stopped, the third adaptive algorithm execution unit 52 executes the adaptive algorithm from the error EK(z) and the audio X(z) by setting the output of the subtractor 156 as the error EK(z) in order to set the transfer function K(z) of which the error EK(z) becomes 0 to be the transfer function K(z) of the third variable filter 51.

If the transfer function K(z) for the third variable filter 51 is converged, the operation of the third adaptive algorithm execution unit 52 is stopped, the learning processing of the second stage is terminated, the learning microphone 400 is removed, the operation of the adaptive algorithm execution unit 152 is started while the operation of the second adaptive algorithm execution unit 42 and the operation of the third adaptive algorithm execution unit 52 are stopped, and the learning processing is completed.

Next, the rear canceling device 25 will be described.

With reference to the explanation of the front canceling device 15 described above, in the rear canceling device 25, the front and rear are exchanged.

Embodiments and implementations of the present disclosure have been described above.

Figure 7:
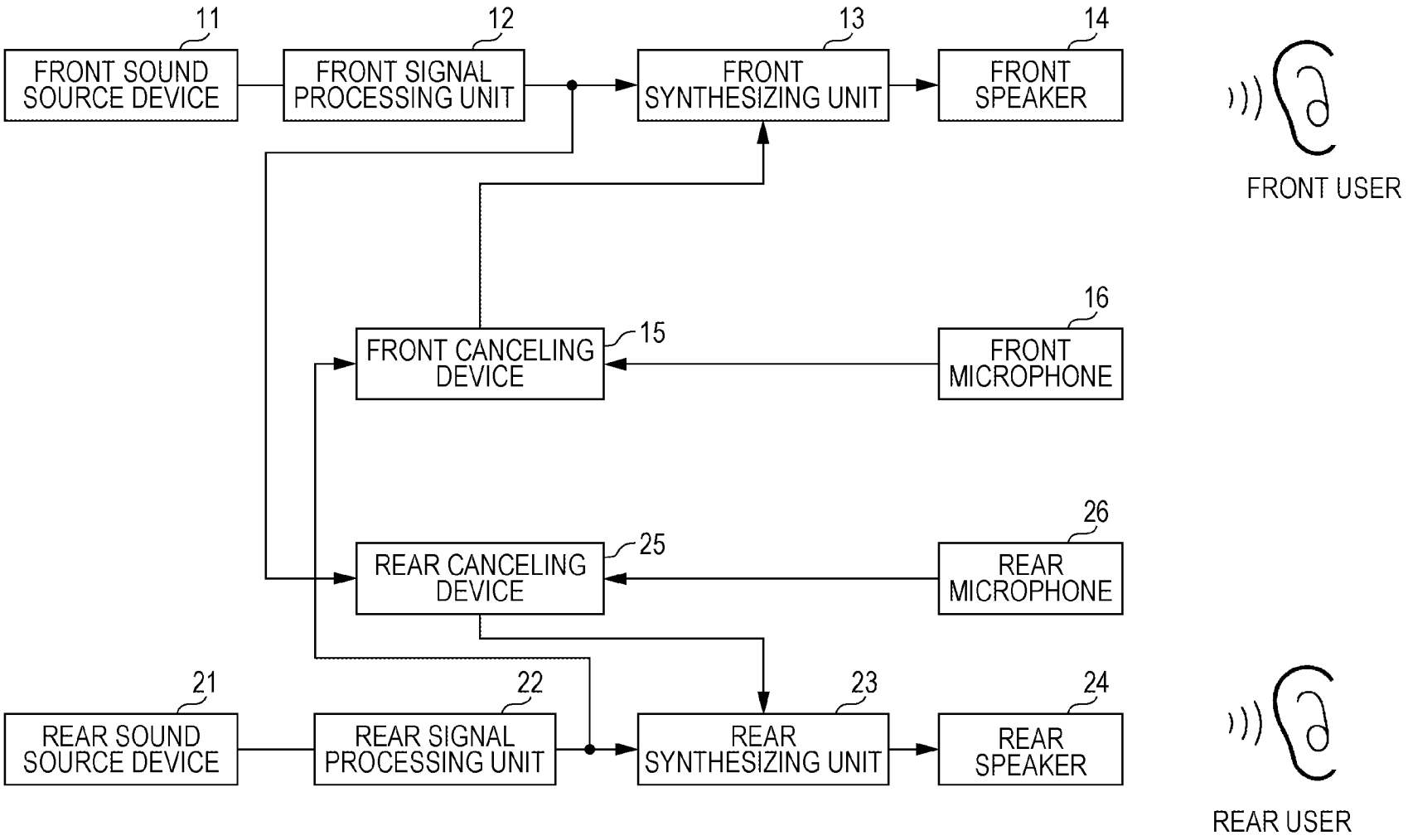
FIG. 7 is a block diagram illustrating another form of a configuration of an audio system.

As illustrated in FIG. 7, the audio system may be configured to input the output of the rear signal processing unit 22 instead of the output of the rear sound source device 21 to the front canceling device 15, perform processing using the output of the rear signal processing unit 22 instead of the output of the rear sound source device 21 in the front canceling device 15, input the output of the front signal processing unit 12 instead of the output of the front sound source device 11 to the rear canceling device 25, and perform processing using the output of the front signal processing unit 12 instead of the output of the rear sound source device 21 in the rear canceling device 25.

Figure 8:
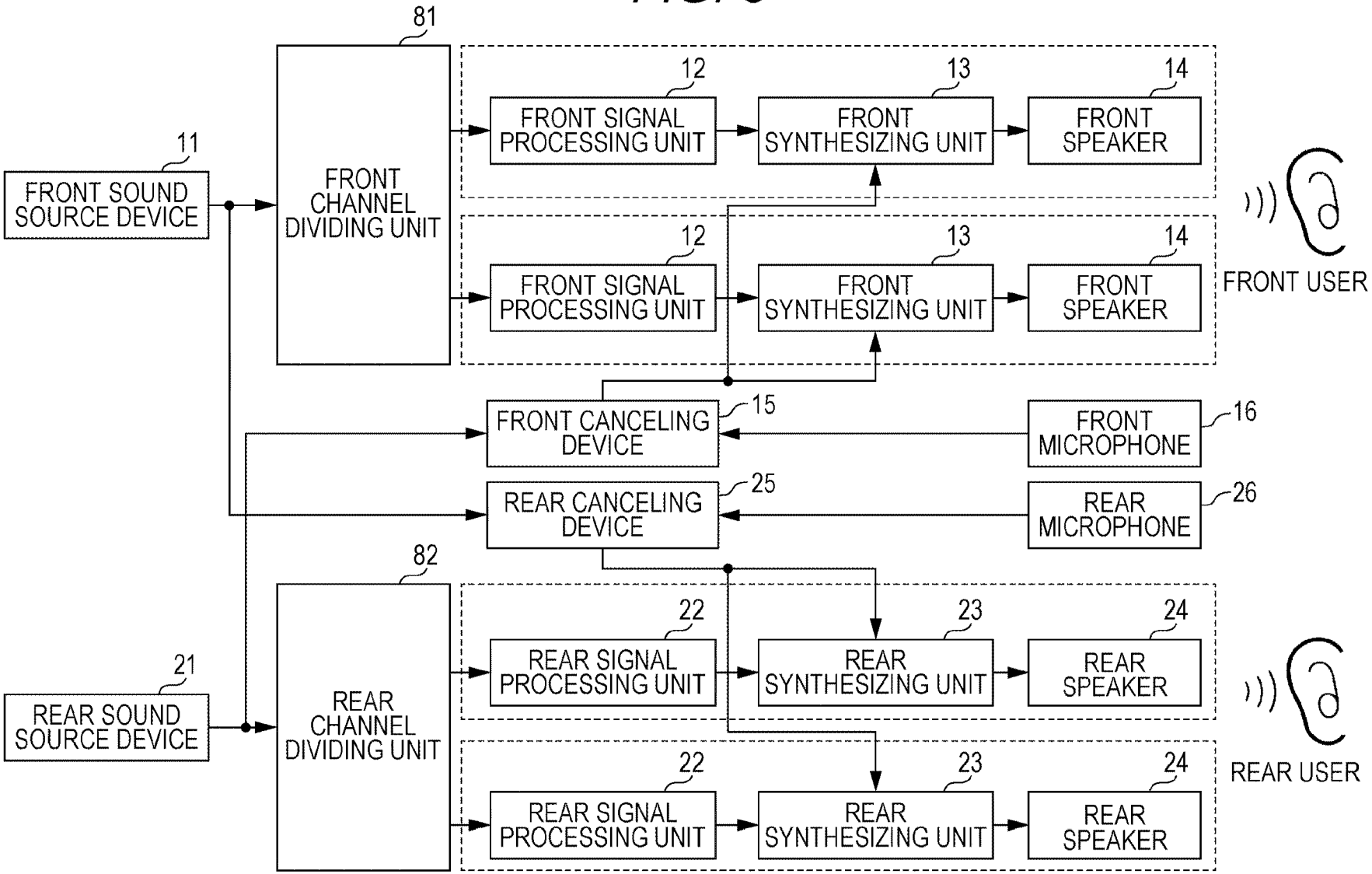
FIG. 8 is a block diagram illustrating another form of a configuration of an audio system.

In addition, as illustrated in FIG. 8, the audio system may include a front channel division unit 81 configured to divide the output of the front sound source device 11 into a plurality of front channels, and a rear channel division unit 82 configured to divide the output of the rear sound source device 21 into a plurality of rear channels, a set of the front signal processing unit 12, the front synthesizing unit 13, and the front speaker 14 for each of the front channels, and a set of the rear signal processing unit 22, the rear synthesizing unit 23, and the rear speaker 24 for each of the rear channels.

As described above, when the set of the front signal processing unit 12, the front synthesizing unit 13, and the front speaker 14 is provided for each of the plurality of front channels and the set of the rear signal processing unit 22, the rear synthesizing unit 23, and the rear speaker 24 is provided for each of the plurality of channels, if as illustrated in FIG. 7, the input of the front canceling device 15 is replaced with the output of the rear sound source device 21 to be the output of the rear signal processing unit 22 or the input of the rear canceling device 25 is replaced with the output of the front sound source device 11 to be the output of the front signal processing unit 12, the front canceling device 15 for each front channel or the rear canceling device 25 for each rear channel is required, such that it is preferable that as illustrated in FIG. 8, the output of the rear sound source device 21 is input to the front canceling device 15 and the output of the front sound source device 11 is input to the rear canceling device 25.

Although above embodiments and implementations have been described by taking the application to the audio system as an example, the present embodiments and implementations can be applied to the noise cancellation of an arbitrary noise source in the same manner.

That is, for example, in the case of canceling, as noise at the ear of the front user, an engine sound generated from an engine serving as a sound source, the engine sound picked up by a microphone separately provided may be input to the front canceling device instead of the output of the rear sound source device 21 or the simulating sound obtained by simulating the engine sound generated from a simulating sound generating device separately provided is input to the front canceling device instead of the output of the rear sound source device 21.

What is claimed is:

1. An on-vehicle audio system mounted in a vehicle, comprising:

an active noise control device for reducing noise, comprising:

a speaker configured to output a cancellation sound which cancels noise at a predetermined noise cancel position;

a microphone configured to pick-up a synthetic sound of the noise with the cancellation sound and to output the picked up synthetic sound as an error signal; and a cancellation sound generation unit configured to generate the cancellation sound output from the speaker, wherein the cancellation sound generation unit includes:

an adaptive filter configured to use, as an input, a noise signal which is a signal indicating noise which a noise source of the noise generates;

a first filter configured to use an output of the adaptive filter as an input and to output the cancellation sound; and a second filter configured to use the output of the adaptive filter as an input, wherein the adaptive filter is configured to update a transfer function for the adaptive filter by a predetermined adaptive algorithm using a difference between an output of the microphone and an output of the second filter as an error, wherein a transfer function for the first filter is set in the first filter, and the transfer function for the first filter is set so that the noise at the noise cancellation position is canceled when the cancellation sound generation unit generates, as the cancellation sound, a sound which is obtained by applying the transfer function for the first filter to the noise signal in a predetermined standard state, and wherein a transfer function for the second filter is set in the second filter, and the transfer function for the second filter is set so that the error is an output of a virtual microphone disposed at the noise cancellation position when the transfer function for the adaptive filter is a transfer function which sets, as an output, an input as it is in the predetermined standard state; and an audio device for a user who sits in a first seat of the vehicle, the audio device configured to emit audio into the vehicle, wherein:

the noise is the audio which is emitted from the audio device, the noise signal is an audio signal output from a sound source of the audio device, the noise cancellation position is a position of an ear of a user who sits in a second seat of the vehicle, and the microphone is disposed near the position of the ear of the user who sits in the second seat.

2. An active noise control device reducing noise, comprising:

a speaker configured to output a cancellation sound which cancels noise at a predetermined noise cancel position;

a microphone configured to pick-up a synthetic sound of the noise with the cancellation sound and to output the picked-up synthetic sound as an error signal; and a cancellation sound generation unit configured to generate the cancellation sound output from the speaker, wherein the cancellation sound generation unit includes:

an adaptive filter configured to use, as an input, a noise signal which is a signal indicating noise which a noise source of the noise generates;

a first filter configured to use an output of the adaptive filter as an input and output the cancellation sound; and a second filter configured to use the output of the adaptive filter as an input, wherein the adaptive filter is configured to update a transfer function of the adaptive filter by a predetermined adaptive algorithm using a difference between an output of the microphone and an output of the second filter as an error, wherein a transfer function for the first filter learned by a predetermined learning processing is set in the first filter and a transfer function for the second filter learned by the learning processing is set in the second filter, wherein the transfer function for the first filter is:

$$-V(z)/Sv(z)$$

where V(z) is set as a transfer function from the noise source to the noise cancellation position and Sv(z) is set as a transfer function from the cancellation sound generation unit to the noise cancellation position at a time when the learning processing is executed, and wherein the transfer function for the second filter is:

$$P(z)\{V(z)/Sv(z)\}S(z)$$

where P(z) is set as a transfer function from the noise source to the microphone and S(z) is set as a transfer function from the cancellation sound generation unit to the microphone at a time when the learning processing is executed.

3. The active noise control device according to claim 2, further comprising:

a learning processing execution unit configured to perform the learning processing to set the transfer function for the first filter in the first filter and the transfer function for the second filter in the second filter.

4. An on-vehicle audio system mounted in a vehicle and including the active noise control device according to claim 3, the on-vehicle audio system comprising:

an audio device for a user who sits in a first seat of the vehicle, where the audio device is configured to emit audio into the vehicle, wherein:

the noise is audio which is emitted from the audio device, the noise signal is an audio signal output from a sound source of the audio device, the noise cancellation position is a position of an ear of a user who sits in a second seat of the vehicle, and the microphone is disposed near the position of the ear of the user who sits in the second seat.

5. An active noise control device reducing noise, comprising:

a speaker configured to output a cancellation sound which cancels noise at a predetermined noise cancel position;

a microphone configured to pick-up a synthetic sound of the noise with the cancellation sound and to output the picked-up synthetic sound as an error signal; and a cancellation sound generation unit configured to generate the cancellation sound output from the speaker, wherein the cancellation sound generation unit includes:

an adaptive filter configured to use, as an input, a noise signal which is a signal indicating noise which a noise source of the noise generates;

a first filter configured to use an output of the adaptive filter as an input and to output the cancellation sound; and a second filter configured to use the output of the adaptive filter as an input, wherein the adaptive filter is configured to update the transfer function of the adaptive filter by a predetermined adaptive algorithm using a difference between an output of the microphone and an output of the second filter as an error, wherein a transfer function for the first filter learned by a predetermined learning processing is set in the first filter and a transfer function for the second filter learned by the learning processing is set in the second filter, and wherein the learning processing comprises:

learning, as the transfer function for the first filter, a first transfer function of which the noise at the noise cancellation position is canceled in the configuration in which the cancellation sound generation unit is replaced with a first learning unit configured to generate, as the cancellation sound, a sound obtained by applying the first transfer function to the noise signal, and learning, as the transfer function for the second filter, a second transfer function without the difference between the output of the microphone and the sound obtained by applying the second transfer function to the noise signal in the configuration in which the cancellation sound generation unit is replaced with the second learning unit configured to generate, as the cancellation sound, the sound obtained by applying the transfer function for the first filter to the noise signal.

6. The active noise control device according to claim 5, further comprising:

a learning processing execution unit configured to perform the learning processing to set the transfer function for the first filter in the first filter and to set the transfer function for the second filter in the second filter.

7. An on-vehicle audio system mounted in a vehicle and including the active noise control device according to claim 6, the on-vehicle audio system comprising:

an audio device for a user who sits in a first seat of the vehicle, where the audio device is configured to emit audio into the vehicle, wherein the noise is audio which is emitted from the audio device, wherein the noise signal is an audio signal output from a sound source of the audio device, wherein the noise cancellation position is a position of an ear of a user who sits in a second seat of the vehicle, and wherein the microphone is disposed near the position of the ear of the user who sits in the second seat.

* * * * *